US009709282B1

(12) United States Patent
Fomenko et al.

(10) Patent No.: US 9,709,282 B1
(45) Date of Patent: Jul. 18, 2017

(54) DEVICE FOR SIMULATING A FLAME EFFECT

(71) Applicant: AFC (ALEX FIREPLACE COMPANY) LIMITED, London (GB)

(72) Inventors: Aleksey Yurievich Fomenko, Arkhangelskaya oblast (RU); Semen Vladimirovich Karpov, Moscow (RU); Nikita Eduardovich Norkin, Moscow (RU); Yuri Nikolaevich Litvak, Moskovskaya oblast (RU)

(73) Assignee: AFC (ALEX FIREPLACE COMPANY) LIMITED, London (GB)

( * ) Notice: Subject to any disclaimer, the term of this patent is extended or adjusted under 35 U.S.C. 154(b) by 0 days.

(21) Appl. No.: 15/231,554

(22) Filed: Aug. 8, 2016

(51) Int. Cl.

| | |
|---|---|
| ***A63J 5/04*** | (2006.01) |
| ***F21S 10/04*** | (2006.01) |
| ***F24C 7/00*** | (2006.01) |
| ***B05B 17/06*** | (2006.01) |
| ***B05B 7/00*** | (2006.01) |
| ***F21S 10/00*** | (2006.01) |
| *F21W 121/00* | (2006.01) |

(52) U.S. Cl.
CPC ..... *F24C 7/004* (2013.01); *B05B 7/0081* (2013.01); *B05B 17/0615* (2013.01); *B05B 17/0676* (2013.01); *F21S 10/002* (2013.01); *F21S 10/04* (2013.01); *F21W 2121/00* (2013.01)

(58) Field of Classification Search
CPC F24C 7/00; F24C 7/004; F24C 13/006; F21S 10/00; F21S 10/04; F24B 1/1808; G09F 19/00; G09F 19/12; A63J 5/00; A63J 5/023; A63J 5/025; A63J 5/04
USPC ..... 472/57, 64, 65; 40/427, 428
See application file for complete search history.

(56) References Cited

U.S. PATENT DOCUMENTS

| | | | | |
|---|---|---|---|---|
| 6,050,011 | A * | 4/2000 | Hess | F21S 10/04 40/427 |
| 7,162,820 | B2 * | 1/2007 | Hess | F24C 7/004 40/428 |
| 8,413,358 | B2 | 4/2013 | Betz | |
| 8,671,600 | B2 * | 3/2014 | Lu | F24B 1/1808 40/428 |

(Continued)

FOREIGN PATENT DOCUMENTS

| | | |
|---|---|---|
| GB | 512481 A | 9/1939 |
| GB | 2395550 A | 5/2004 |

(Continued)

*Primary Examiner* — Kien Nguyen
(74) *Attorney, Agent, or Firm* — Andrew W. Chu; Craft Chu PLLC

(57) ABSTRACT

The device for simulating a flame effect includes a mist generator having a housing with an outlet aperture for mist; at least one ultrasonic sprayer of a liquid for generating mist, which is arranged in the housing; a mechanism for pulse supply of a liquid onto the ultrasonic sprayer of the mist generator; a mechanism for outputting of mist via the outlet aperture of the mist generator; at least one light source arranged so as to be able to illuminate a mist current escaping from the outlet aperture of the mist generator for simulation of the flame effect. The technical effect is improved uniformity of a formed mist current, reduced dimensions of the device, simplified construction, improved operational stability, and less contamination of the generator.

19 Claims, 8 Drawing Sheets

(56) References Cited

U.S. PATENT DOCUMENTS

| | | | | |
|---|---|---|---|---|
| 2007/0107280 | A1* | 5/2007 | Stinson | F24C 7/004 40/428 |
| 2010/0031543 | A1* | 2/2010 | Rice | F24C 7/004 40/428 |

FOREIGN PATENT DOCUMENTS

| | | | |
|---|---|---|---|
| RU | 137598 | | 2/2014 |
| WO | 2006027272 | A1 | 3/2006 |

* cited by examiner

DEVICE FOR SIMULATING A FLAME EFFECT

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to the field of devices for electric fires and, in particular, to a device configured to simulate flame and smoke forming during combusting of a solid fuel.

2. Description of Related Art Including Information Disclosed Under 37 CFR 1.97 and 37 CFR 1.98.

Electric fires are used as substitutes for conventional fireplaces designed for combusting a fuel. Contrary to fuel fireplaces, heat, as produced by an electric fire, is generated at the time of switching it on, and no cleaning being required.

During the process of making new developments in the field of fires, their elements simulating fuel combustion with emission of flame and smoke are the main task of improvement.

Earlier, flickering flame simulation was achieved by using strips of a light material (bands) oscillating under the influence of an air current directed thereon. But, such simulation is far from being capable of creating real perception.

Another technical solution aimed at flickering flame simulation consists in projecting light emitted from a light source and passing via rotating blades of a fan on a screen, said blades being formed as an involute curve, which enables to display a movable front of a combusted fuel. This decision is described in GB Patent No. GB512481, 18.09.1939. The main structural elements of the patented fire is a grating, on which a fuel simulator is arranged, a light source, a screen and a fan.

An improved structure of a fire with optical simulation of flame is disclosed in GB Patent No. GB2395550, 30.08.2006, wherein light is fed from light sources to a light filter made in the form of a comb, and above the said filter a rotatable shaft is arranged that is provided with elements in the form of petals. After falling on the rotating shaft provided with petals, light acquires the motion effect, and when it falls on light and dark areas of the light filter, the intermittent motion effect is created. The front screen having etched regions serves as a diffraction grating, and thus produced light becomes diffused and more real.

Fires are known, wherein not only flame, but also smoke emitted by a fuel are simulated. Thus, International Application No. WO2006027272, publ. 16.03.2006, discloses a flame simulation device using vapor produced by vaporizing a liquid, e.g., glycol, in a smoke generator. Rising vapor that passes via apertures in a simulated fuel bed is illuminated by light sources, which creates the smoke and flame effect. This construction provides for vapor regeneration. It passes between the fire walls and returns into the inlet aperture where it is heated and rises again.

U.S. Pat. No. 8,413,358, publ. 09.04.2013, discloses a flame effect fire comprising a main reservoir and an additional reservoir that contain a liquid, a mist generator, a light source (or sources), a fan, a fuel bed with fuel elements. The mist generator may comprise one or more ultrasonic transducers operable by a controller in order to control a volume of mist produced. Said ultrasonic transducers may be arranged on the bottom of the reservoir provided with a liquid.

The analogous solution closest to the claimed invention is a flame simulation device disclosed in RF Utility Model Patent No. RU137598, publ. 20.02.2014. This device comprises a mist generator having a housing with outlet apertures, the housing being provided with ultrasonic transducers designed for spraying a liquid, thus ensuring mist generation, a reservoir for a liquid, which is connected to the mist generator, means for supplying a liquid from the reservoir to an evaporator, a means for air delivery (a fan) arranged so as to be able to output mist via the generator outlet apertures, and light sources (31) arranged so as to be able to illuminate mist escaping from the generator. The means for supplying a liquid are made in the form of channels (12) at which outputs the ultrasonic transducers are arranged that ensure spraying of a liquid.

Drawbacks of the conventional devices for simulating flame effect are large dimensions, high cost as well as contamination of ultrasonic sprayers.

BRIEF SUMMARY OF THE INVENTION

The objective of the invention as claimed is elimination of the above drawbacks.

The technical effect of the invention is improved uniformity of a formed mist current, reduction of the device dimensions, a simplified construction, improved operational stability, and less contamination of the generator.

The above technical effect is achieved due to that the device for simulating flame effect comprises a mist generator having a housing provided with an outlet aperture for mist and at least one ultrasonic liquid sprayer arranged in the housing and ensuring mist (3) generation, means for pulse supply of a liquid to the ultrasonic sprayer (2) arranged within the mist generator (1), a means (6) for outputting mist (3) via an outlet aperture (10) of the mist generator, and at least one light source (8) arranged so as to be able to illuminate a mist current (3) escaping from the outlet aperture (10) of the mist generator for ensuring simulation of the flame effect.

Also, some particular embodiments are provided, according to which:

the device further comprises a reservoir for a liquid, which is connected to the mist generator;

the device further comprises a dispenser for forming a directed mist current, which is aligned with the outlet aperture of the mist generator;

the mist generator is arranged within a simulated log in an artificial fuel bed;

the housing of the mist generator is made in the form of a container and has a cover in the form of a radiator with said at least one light source arranged thereon;

in addition, at least one heating element is arranged on the radiator;

the radiator has projecting elements for heating of the air in the housing of the mist generator;

the outlet aperture of the mist generator is made in the radiator;

the wall of the mist generator housing and the radiator are arranged with a gap therebetween and have projections forming the outlet aperture of the mist generator in the form of a slit;

the bottom of the mist generator housing is made inclined and has at least one aperture for discharging condensate;

an ultrasonic membrane is used as the ultrasonic sprayer;

the ultrasonic membrane is oriented horizontally;

the ultrasonic membrane is oriented vertically;

the means for pulse supply of a liquid are made so as to be able to supply a liquid onto the ultrasonic membrane in the form of drops or streams;

the means for pulse supply of a liquid comprise at least one tube for supplying a liquid, said tube being connected to the reservoir for a liquid or a liquid supply line via a pipeline and/or a channel;

the means for pulse supply of a liquid further comprise a control unit for controlling pulse supply of a liquid;

the means for pulse supply of a liquid comprise at least one pump for pumping a liquid into the tube for pulse supply of a liquid;

the ultrasonic membrane on one side contacts a liquid in the channel connecting the tube for pulse supply of a liquid and the reservoir and is made so as to be able to oscillate for the purpose of ensuring pumping of a liquid from the reservoir into the tube;

the means for outputting mist comprises a fan for supplying air into the housing of the mist generator via its inlet aperture.

Unlike the analogous solutions, the invention as claimed realizes pulse supply of a liquid onto an ultrasonic sprayer in the form of small doses (drops, streams, and the like) for the purpose of forming mist.

Pulse supply has the following advantages:

1) uniformity of a mist current escaping from the generator is improved, which ensures more real image when a light flux is projected on mist;

2) dimensions of the mist generator are reduced, since a minimum quantity of a liquid is in the dispersion area of the mist generator, due to which a liquid does not occupy the useful volume of the dispersion area, and, accordingly, the dispersion area may have minimum dimensions. Minimum dimensions of the mist generator also ensure flexible arrangement of the whole device;

3) the operational stability of the generator is improved, since a liquid supplied onto the ultrasonic sprayer (membrane) does not contact the membrane directly before dispersion and is not heated by the membrane during operation;

4) amount of scale accumulating on the ultrasonic sprayer (especially on that arranged vertically) is reduced, which prolongs its service life, since ultrasonic sprayers are not in permanent contact with the whole liquid volume;

5) cost is reduced, since no means for liquid level maintenance are required for operation of the device for simulating flame effect;

6) all liquid coming onto the sprayers can be sprayed. Thus, after switching the system for simulating flame effect off, it would not contain any liquid where microorganisms may potentially propagate.

BRIEF DESCRIPTION OF THE SEVERAL VIEWS OF THE DRAWINGS

The invention is explained with the accompanying drawings.

The elements in the Figures are designated as follows.

Figure 1:
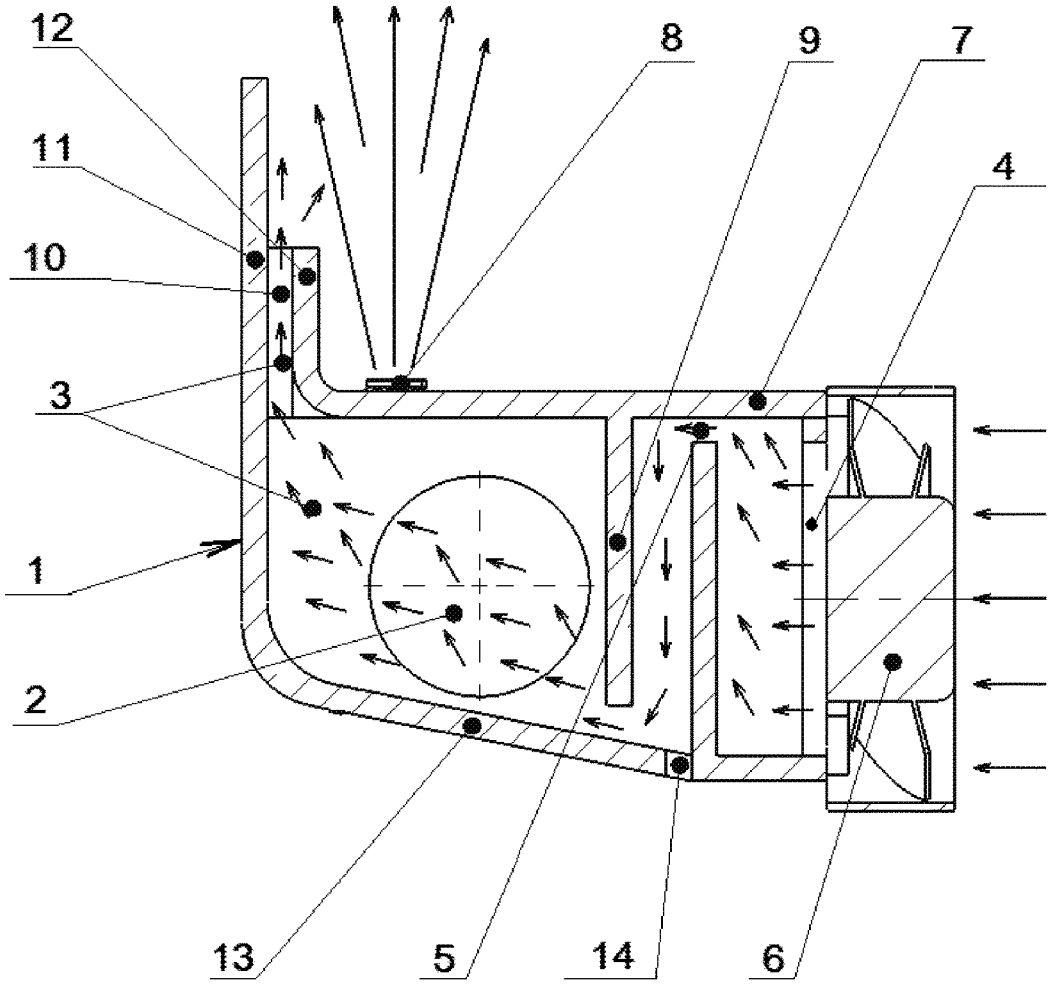
FIG. 1 shows a general sectional view of the device according to the first embodiment.
Figure 2:
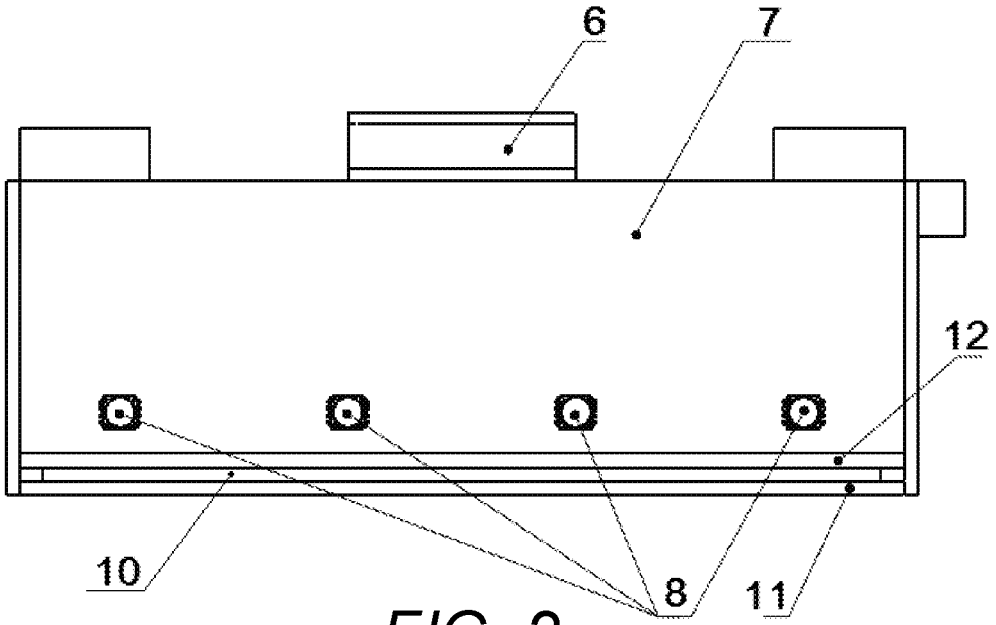
FIG. 2 shows a top plan view of the device according to the first embodiment.
Figure 3:
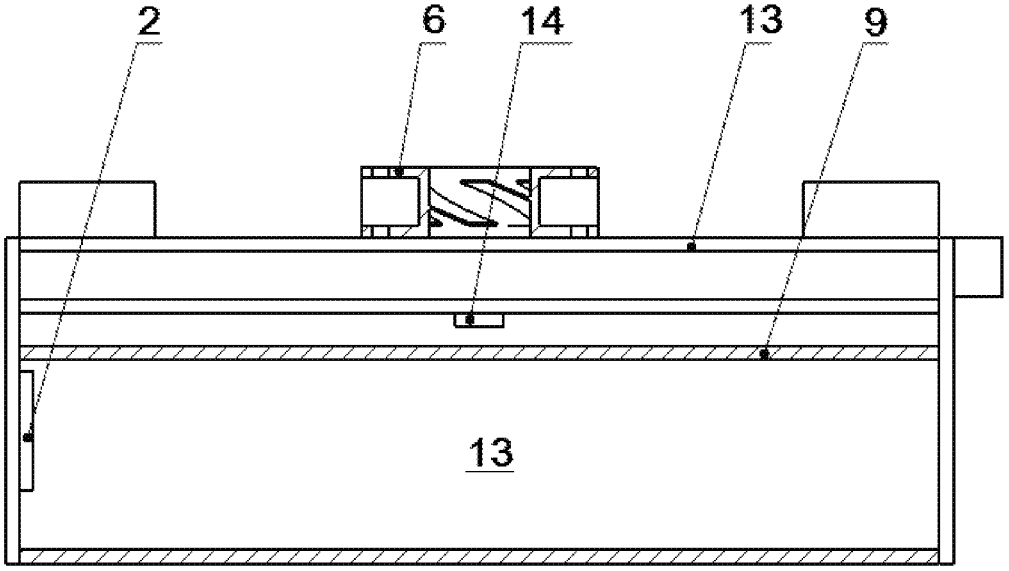
FIG. 3 shows a sectional view along the lower border of the horizontal plane of the device radiator according to the first embodiment.
Figure 4:
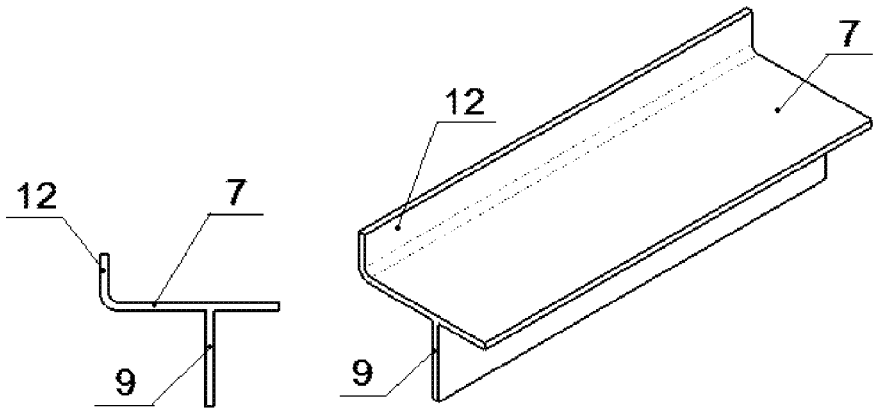
FIG. 4 shows an end view and a perspective view of the device radiator according to the first embodiment.
Figure 5:
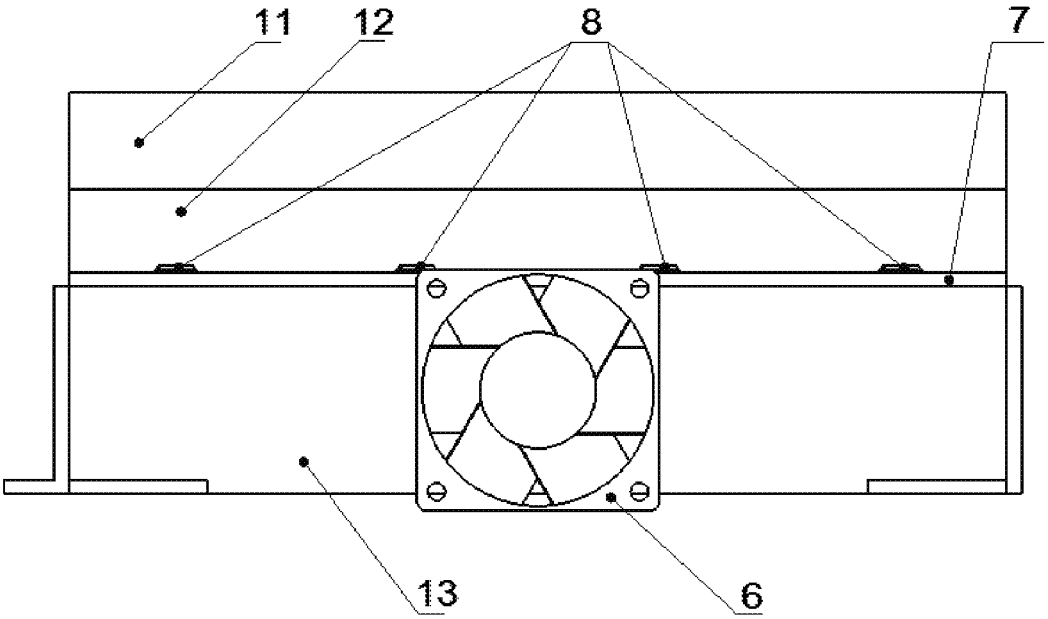
FIG. 5 shows a rear elevation view of the device according to the first embodiment.
Figure 6:
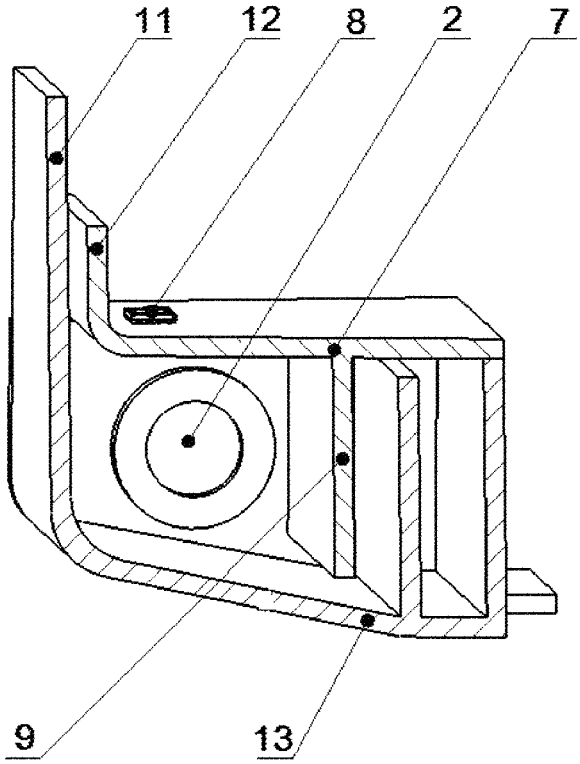
FIG. 6 shows an inner sectional view of the mist generator housing of the device according to the first embodiment.

1—mist generator
2—ultrasonic sprayer of a liquid (membrane)
3—mist
4—inlet aperture of the mist generator
5—inlet slit of the mist generator
6—means for outputting mist (fan)
7—radiator
8—light source
9—aerodynamic elements (fins) of the radiator
10—outlet aperture of the mist generator
11—projection of the mist generator housing
12—projection of the radiator
13—bottom of the mist generator housing
14—drain aperture of the mist generator housing
15—simulated charcoal bed
16—simulated logs
17—support plate
18—tube for pulse supply of a liquid onto the membranes
19—inlet fitting of the mist generator
20—outlet fitting of the mist generator
21—housing of the flame simulation unit
22—dispenser
23—substrate for light sources
24—partition
25—reservoir for a liquid
26—cover of the flame simulation unit housing
27—bottom of the flame simulation unit housing

28—pump for a liquid
29—control board
30—pipeline (hose)
31—channel for supply of a liquid.

DETAILED DESCRIPTION OF THE INVENTION

The device for simulating flame effect according to the first embodiment of the invention (FIGS. 1-6) utilizes the modular concept and comprises the mist generator (1), which housing is a spreading container. The housing of the mist generator (1) accommodates one or more ultrasonic liquid sprayers (2) in the form of ultrasonic membranes of piezoceramic radiators. The ultrasonic membrane (2) is oriented vertically in the housing of the mist generator (1) and is arranged so that a mist current generated thereby fills a maximum possible volume of the housing container. One example of this arrangement may be the arrangement in a container end. The ultrasonic membrane (2) is adapted for operation in the mode of generating mist (3) when it receives a pulse-supplied (sprayed) liquid in the form of drops or streams from a reservoir for a liquid or via a pipeline (water line) (not shown). Said supply is ensured by control and liquid precision supply means (not shown).

The generator housing has the inlet aperture (4) aligned with a narrow lengthy slit (5) for providing the housing with air at small positive pressure created by the mist outputting means (6) made in the form of a fan.

As the cover of the mist generator housing, a flat radiator (7) is used which outer (upper) surface is provided with light sources (8), e.g., in the form of light-emitting diodes providing LED-backlight in a predetermined configuration that resembles flames, and, if necessary, with heating elements (not shown in the Figures). The radiator (7) is intended for removal heat from the light-emitting diodes and heating elements (if installed) as well as for heating air, as coming into the housing, for forming ascending convective currents of generated mist (3). The lower side of the radiator (7) may have aerodynamic elements (plates, fins) (9) for better transfer of heat to air supplied into the housing as well as for creating, inside the housing, air currents in a required configuration which ensures capture of a maximum amount of mist (3) by the supplied air.

The housing of the mist generator (1) is also provided with an outlet aperture (10) in the form of a slit for outputting of mist (3). Said aperture (10) may be formed both in the radiator (7) itself and due to incomplete covering of the mist generator housing container by the radiator (7) (i.e., due to displacement of the radiator). In particular, the slit of the outlet aperture (10) is formed by projections (11) and (12) that may be structural parts of housing container of the generator (1) and the radiator (7) and are intended for directing a mist current blown out of the container as well as for removing more heat. These projections (11, 12) also may protect the user against action of light sources' direct radiation.

The bottom (13) of the mist generator (1) housing may be made inclined longitudinally or transversally and may have, in its lower portion, one or more apertures (14) for discharging a liquid (draining of condensate).

During operation of the device according to the first embodiment, a dispersed (sprayed) liquid (water or any other liquid suitable for forming mist) is precision-supplied by the pulse supply means (not shown) as microscopic doses onto one or more membranes (2) that form mist (3) in the form of suspended microdrops (aerosol). Mist (3) is picked up by an air current produced by the means (6) for outputting mist (a fan) via the inlet aperture (4) and a lengthy slit (5) and leaves the container via the outlet aperture (10). A light flux produced by the light sources (8), which are arranged on the radiator (7), is dispersed on particles of mist (3) escaping from the container, and, due to that, the effect of simulated flame flickering is achieved. Heat produced by the light sources (8) (and by heating elements) is transferred to the radiator (7) that additionally heats an air current passing through the housing of the mist generator (1), thus ensuring formation of ascending aerosol flows at the output of the mist generator (1) due to convection, and this, in turn, creates the flame motion effect and increases the flame height visually.

Figure 7:
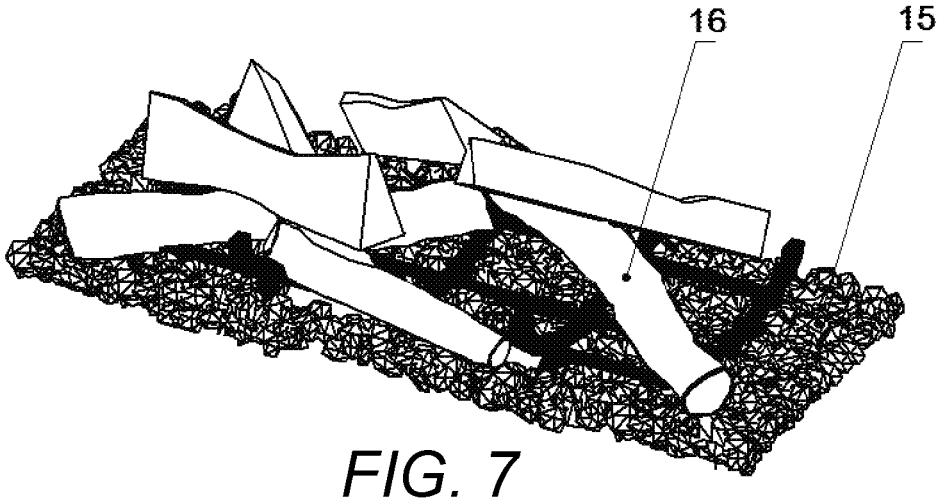
FIG. 7 shows a general schematic view of the device according to the second embodiment.
Figure 8:
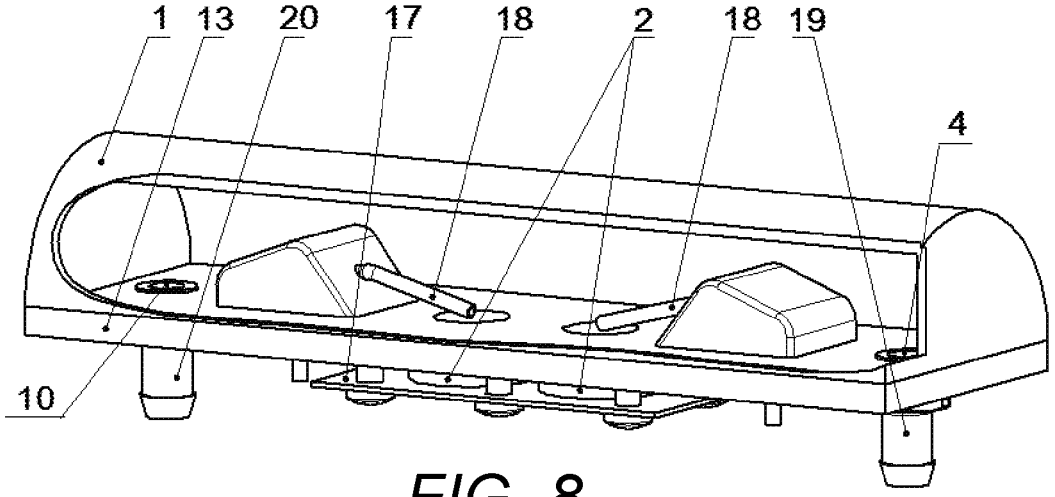
FIG. 8 shows a perspective view of the mist generator of the device according to the second embodiment.

The device according to the second embodiment of the invention (FIGS. 7 and 8) has a detachable concept. FIG. 7 shows an artificial fuel bed simulating a charcoal layer (15) and logs (16) arranged thereon in the fire chamber. One of the simulated logs contains the mist generator (1) of the claimed device, as shown in FIG. 8.

The bottom (13) of the generator (1) housing, which serves as a substrate, is provided with ultrasonic sprayers (2) of a liquid in the form of membranes fixed by a support plate (17) pressing the membranes (2) to the bottom (13). The evaporation surface of the membranes (2) is oriented horizontally. The housing of the mist generator (1) accommodates means for pulse supply of a liquid onto the membranes (2), said means being made as tubes (18) connected to the liquid reservoir or a pipeline (not shown) by channels. The bottom of the mist generator housing is provided with the inlet aperture (4) having a fitting (19) for the purpose of delivering air with the use of a means (not shown) for outputting mist, as well as with the outlet aperture (10) having an outlet fitting (20) for the purpose of discharging an air-mist mixture.

During operation of the device, similarly to that of the first embodiment, a liquid (water) is supplied as drops from the reservoir by a pump (not shown) onto the ultrasonic membranes (2) with the use of the pulse supply means (tubes (18)) via the channels. The membranes transform the liquid drops coming thereon into mist that accumulates within the space of the mist generator made as a simulated log (16). Air is supplied via the inlet fitting (19) from the fan (not shown) into the housing of the mist generator (1), which air escapes via the fitting (20), entraining mist and formed condensate. Then an air-mist mixture enters into a dispenser (not shown) from where it is uniformly supplied through the slits into a space above the simulated logs and, with the use of the light sources (not shown), flames are simulated. Condensate, which entered the dispenser, is discharged back into the water reservoir via the aperture provided with a hose.

Figure 9:
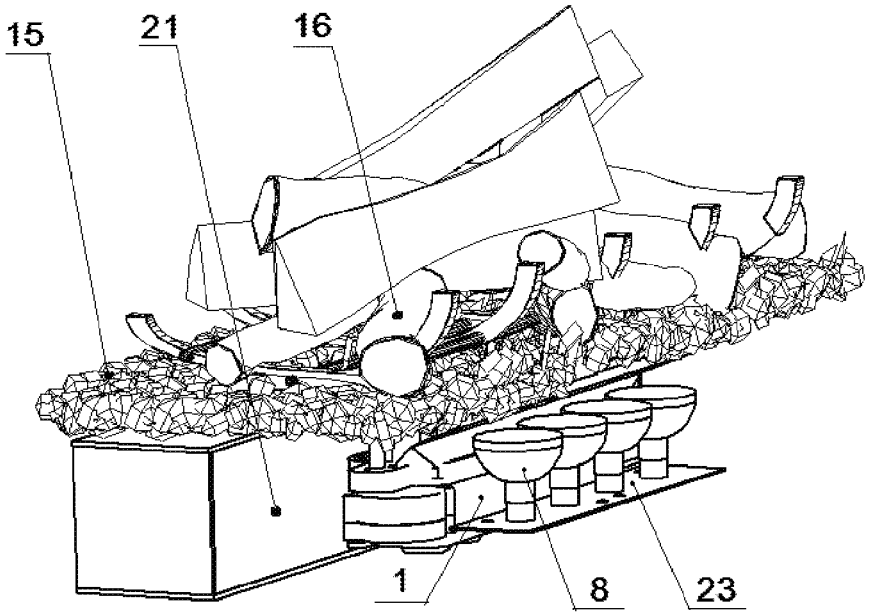
FIGS. 9 and 10 show a general perspective views of the device according to the third embodiment.
Figure 10:
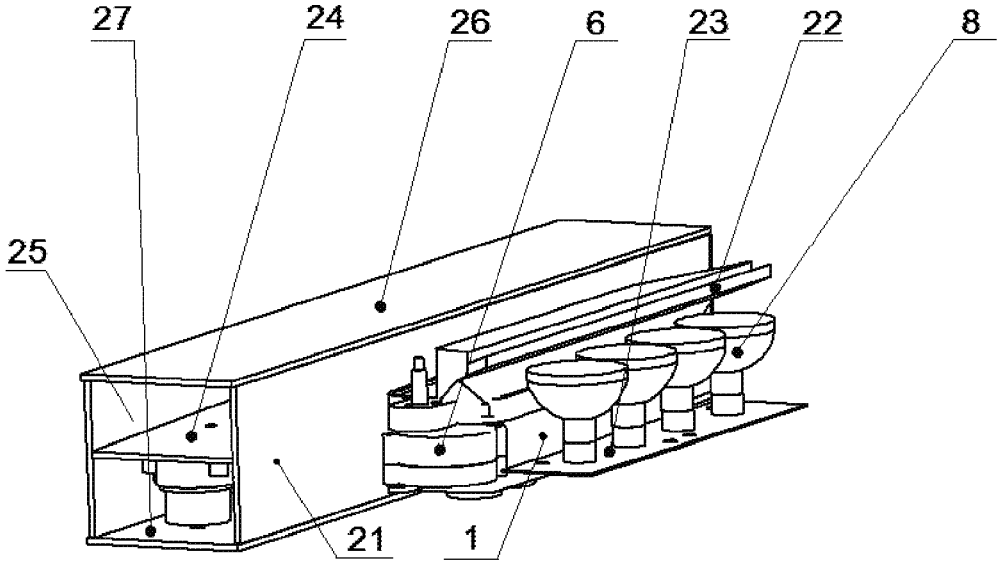
Figure 11:
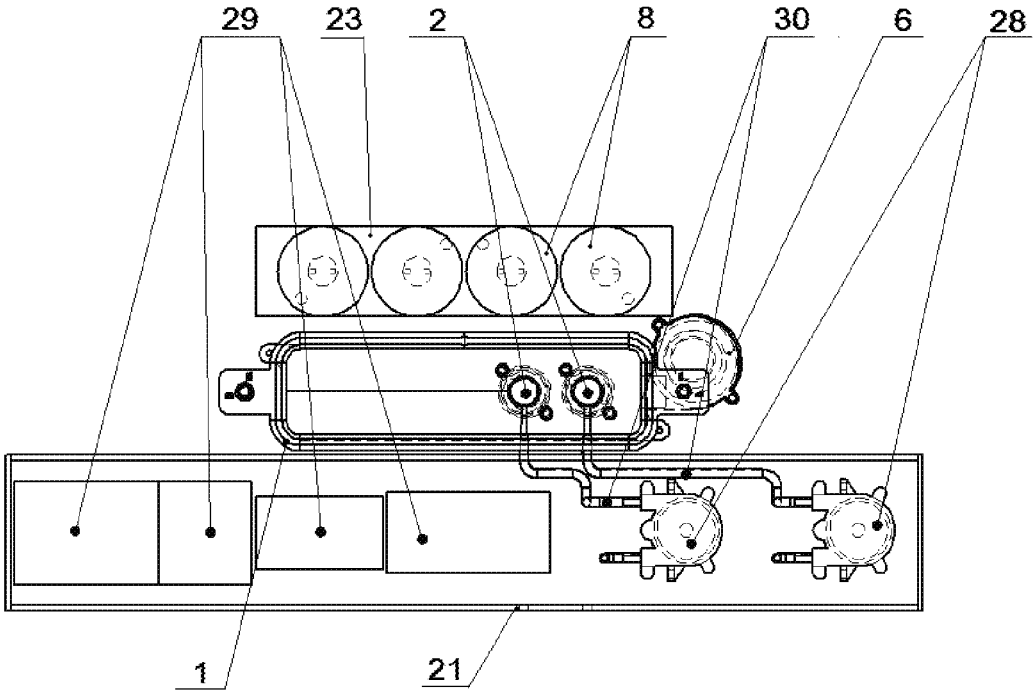
FIG. 11 shows a top sectional view of the device according to the third embodiment.

The device according to the third embodiment of the invention (FIGS. 9-11) has a modular concept. FIG. 9 shows an artificial fuel bed simulating a charcoal layer (15) and logs (16) under which the flame simulation unit of the device is arranged.

The flame simulation unit (FIGS. 10-11) comprises the housing (21) and the mist generator (1) with the ultrasonic membranes (2), which is arranged on the housing, the dispenser (22), the means for outputting mist (a fan) (6), and the light sources (backlight lamps) (8) that are fixed on the substrate (23). The housing (21) of the flame simulation unit is divided into two areas by a horizontal partition (24) (the housing end wall is not shown in FIG. 10 for convenience). The upper part of the housing forms a reservoir (25) for a liquid and is closed by a cover (26) on top. The lower part of the simulation unit housing (21) accommodates, on its bottom, the electronic and mechanical components of the device, said components comprising two peristaltic pumps (28) and a set of control boards (29) forming the liquid supply control unit. The pumps (28) are connected to the reservoir (25) for a liquid and to the housing of the mist generator (1) by pipelines (hoses). The fan (6) is attached directly to the housing of the mist generator in order to improve its operational efficiency. The dispenser (22) is arranged on the mist generator, so that its aperture is located above the light sources (8).

During operation of the device according to the third embodiment, a liquid (water or any other suitable liquid) is supplied from the reservoir (25) by the pumps (28) via the pipelines as microscopic doses (drops) onto the membranes (2) that form mist. The fan (6) delivers air into the housing of the mist generator (1), which air, entraining mist, escapes via the aperture in the dispenser (22), being lighted by the lamps (8) from below, and goes up via an aperture in the simulated fuel bed, thus creating the effect of flames.

According to the above embodiments of the device, the ultrasonic membranes (2), which are intended for creating mist (3), may be used as pumps for supply a liquid to their surface. In one of the embodiments (FIGS. 12-13) the membrane (2) is arranged in the housing of the mist generator (1) so that one of its sides (the upper side of the membrane (2) in FIG. 12) has the open surface for generating aerosol, and the other side (the lower side of the membrane (2) in FIG. 12) faces the means for supply of a liquid. In this case, the means for supply of a liquid comprise the inlet fitting (19) and the tube (18) for supplying a liquid onto the membrane, said fitting and tube being connected by an internal channel (31) ensuring direct contact of the liquid with the lower surface of the membrane (2). Also, the inlet fitting (19) and the tube (18) are provided with respective return valves (not shown) to prevent a backflow of a liquid.

Figure 12:
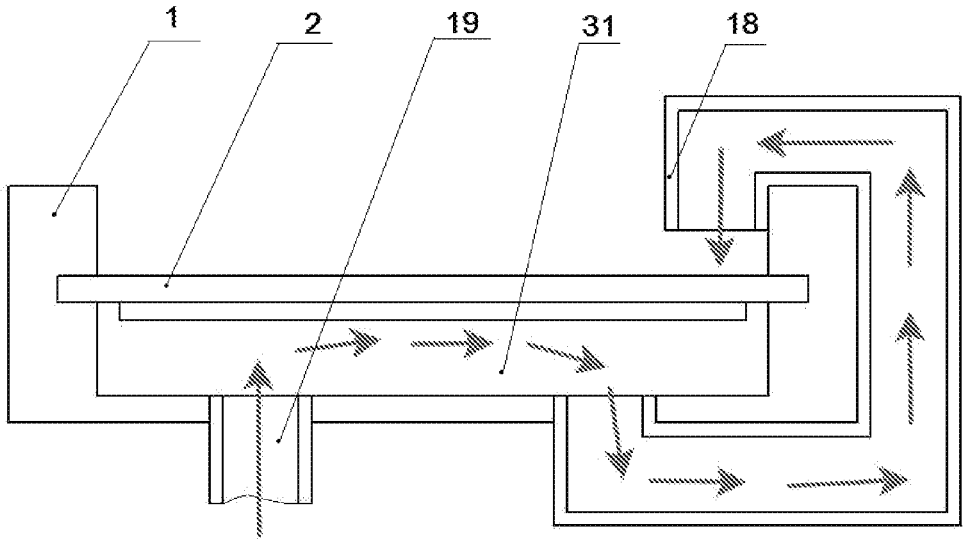
FIGS. 12, 13 show schematic views of one particular embodiment of the ultrasonic membrane and the means for pulse supply of a liquid (a general view and a top view).
Figure 13:
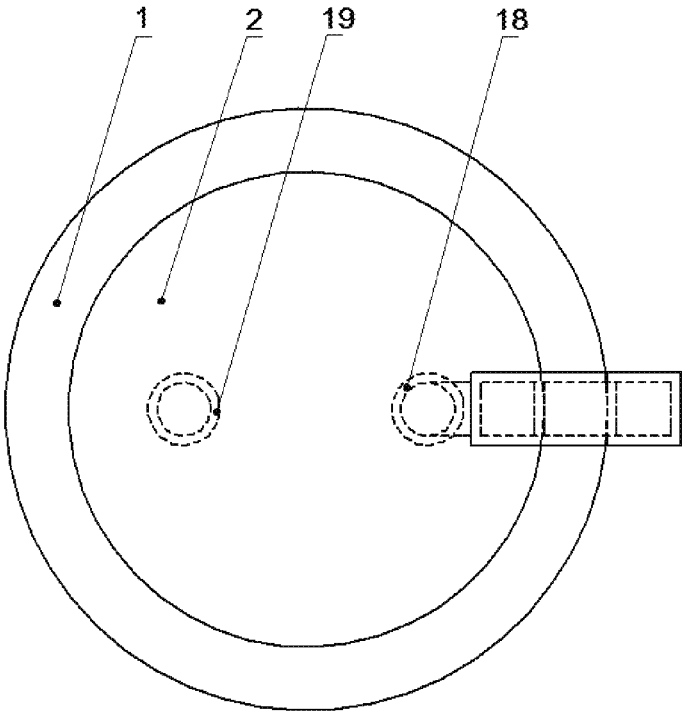

During operation of this assembly, the membrane (2) oscillates in vertical directions (as in FIG. 12). When the membrane (2) moves up, a certain amount of a liquid is caught via the inlet fitting (19) and entrained into the internal channel (31). Afterward, the membrane (2) moves down, and the volume of a liquid, as present in the channel (31), is expelled into the tube (18) due to the return valve arranged at the inlet fitting (19) for preventing a backflow of a liquid. When the membrane (2) moves up again, the return valve at the tube (18) does not allow the liquid to be expelled from the tube (18) back into the internal channel (31). The volume of a liquid, which is transferred by the membrane (2), is controlled by the control and precision-supply systems.

Exemplary Embodiment 1 of the Invention

In order to create the flame simulation effect, the device according to the first embodiment (FIGS. 1-6) is used with a vertically oriented membrane on which a liquid (water) is pulse-supplied as drops at a flowrate from 50 to 100 mL/h via a tube. The oscillation frequency of the membrane is 1.5-1.8 MHz. Formation of a uniform and time-stable current of fine mist is observed. It is additionally determined that mist is most efficiently formed on the condition of supplying the next drop of a liquid not earlier than the previous drop evaporates from the membrane, i.e., when the next drop of a liquid is supplied onto the essentially dry membrane. With due regard to this feature, a feedback system is realized with the use of current control on the membrane, which current changes when the membrane is dry.

Due to inertial operation of the pump in the means for supply of a liquid, situations are detected when a stream of a liquid is supplied onto the membrane instead of a drop. This phenomenon does not result in compromising the mist characteristics. In such a case all excess liquid runs off the membrane and is discharged via the drain aperture.

Exemplary Embodiment 2 of the Invention

The device according to the second embodiment (FIG. 8) is used with a horizontal membrane on which a liquid (water) is pulse-supplied as streams at a flowrate app. 100 mL/h. The oscillation frequency of the membrane is 1.6 MHz. Excess liquid, which is not evaporated, is discharged from the membrane due to its oscillations. As in Example 1, efficient formation of a uniform and time-stable current of mist is observed.

Thus, these tests show that pulse supply of a liquid in the form of separate drops or streams onto either a horizontal membrane or a vertical one enables to form time-stable and uniform current of fine mist ensuring more real simulation of flames, as compared to known analogous solutions wherein a membrane is in permanent contact with a liquid, e.g., is immersed into a liquid.

The above-described embodiments of the device are provided for the purpose of illustrating exemplary constructions possible, but are not aimed at limiting the scope of the claimed invention. Any combinations of the above concepts, as well as other embodiments of the device assemblies are possible, but within the limits of the totality of essential features according to the claimed invention.

We claim:

1. A device for simulating a flame effect, comprising:

a mist generator having a housing with an outlet aperture for mist (3) and at least one ultrasonic sprayer of a liquid for generating mist, means for pulse supply of the liquid onto the at least one ultrasonic sprayer of the mist generator, means for outputting the mist via the outlet aperture of the mist generator, and at least one light source arranged to illuminate a flux of the mist outputted from the outlet aperture of the mist generator, for ensuring simulation of the flame effect.

2. The device according to claim 1, further comprising a reservoir for the liquid, said reservoir connected to the mist generator.

3. The device according to claim 1, further comprising a dispenser for forming a directed flux of the mist, said dispenser aligned with the outlet aperture of the mist generator.

4. The device according to claim 1, further comprising a simulated log of an artificial fuel bed, wherein the mist generator is arranged within the simulated log.

5. The device according to claim 1, wherein the housing of the mist generator is made in the form of a container and provided with a cover in the form of a radiator, wherein at least one light source is arranged on said radiator.

6. The device according to claim 5, further comprising at least one heating element arranged on the radiator.

7. The device according to claim 5, wherein the radiator has projecting elements for heating of air in the housing of the mist generator.

8. The device according to claim 5, wherein the outlet aperture of the mist generator is made in the radiator.

9. The device according to claim 5, wherein a wall of the housing of the mist generator and the radiator are arranged with a gap therebetween and have projections forming the outlet aperture of the mist generator in the form of a slit.

10. The device according to claim 5, wherein a bottom of the housing of the mist generator is made inclined and provided with at least one aperture for draining a condensate.

11. The device according to claim 1, wherein an ultrasonic membrane is used as the ultrasonic sprayer.

12. The device according to claim 11, wherein the ultrasonic membrane is oriented horizontally.

13. The device according to claim 11, wherein the ultrasonic membrane is oriented vertically.

14. The device according to claim 11, wherein the means for pulse supply of the liquid are made to supply the liquid in the form of drops or streams onto the ultrasonic membrane.

15. The device according to claim 11, wherein the means for pulse supply of the liquid comprise at least one tube for pulse supply of the liquid, said at least one tube connected to the reservoir for the liquid or to a liquid supply line via a pipeline and/or a channel.

16. The device according to claim 15, wherein the means for pulse supply of the liquid further comprise a control unit for controlling pulse supply of the liquid.

17. The device according to claim 15, wherein the means for pulse supply of the liquid comprise at least one pump for pumping the liquid from the reservoir into the tube for pulse supply of the liquid.

18. The device according to claim 15, wherein the ultrasonic membrane on one side contacts the liquid in the channel connecting the tube for pulse supply of the liquid and the reservoir, and the ultrasonic membrane is made to oscillate for ensuring transfer of the liquid from the reservoir into the tube.

19. The device according to claim 1, wherein the means for outputting the mist comprises a fan for delivering air into the housing of the mist generator via an inlet aperture of the mist generator.

* * * * *